US007891030B1

(12) United States Patent
Sutton

(10) Patent No.: US 7,891,030 B1
(45) Date of Patent: Feb. 22, 2011

(54) CHILD TRAINING BATHROOM TOILET

(76) Inventor: Faith Sutton, 3339 Carter La., Chester, PA (US) 19013

( * ) Notice: Subject to any disclaimer, the term of this patent is extended or adjusted under 35 U.S.C. 154(b) by 354 days.

(21) Appl. No.: 12/231,352

(22) Filed: Sep. 2, 2008

Related U.S. Application Data

(63) Continuation-in-part of application No. 11/351,701, filed on Feb. 10, 2006, now abandoned.

(60) Provisional application No. 60/652,781, filed on Feb. 14, 2005.

(51) Int. Cl.
*A47K 11/06* (2006.01)

(52) U.S. Cl. ..... 4/483; 4/902

(58) Field of Classification Search ..... 4/479, 4/483–484, 902
See application file for complete search history.

(56) References Cited

U.S. PATENT DOCUMENTS 4,883,749 A * 11/1989 Roberts et al. ..... 434/247
5,008,964 A * 4/1991 Dean et al. ..... 4/661
5,926,864 A * 7/1999 Lynch ..... 4/483
6,038,711 A * 3/2000 Clarke ..... 4/449
6,829,788 B1 * 12/2004 Allen ..... 4/483
2004/0133971 A1 * 7/2004 Davis et al. ..... 4/483

* cited by examiner

*Primary Examiner*—Charles Phillips
(74) *Attorney, Agent, or Firm*—Emery L. Tracy

(57) ABSTRACT

A toilet for use with training a child is provided. The toilet comprises a main toilet portion having a backrest and a pair of arm rests. A bowl rests within the main toilet portion. A seat is positioned over the bowl. A CD player is integrated into the main toilet portion. A plurality of finger-shaped recesses are formed on a top surface and front surface of the arm rests with the child's fingers receivable within the recesses. A sensor is positioned between the main toilet portion and the bowl with the bowl resting upon the sensor wherein upon the child contacting the finger-shaped recesses, the arm rests and recesses light up and make sounds and wherein upon bodily waste entering the bowl, the weight change of the bowl against the sensor automatically activates the CD player.

20 Claims, 3 Drawing Sheets

CHILD TRAINING BATHROOM TOILET

The present application is a continuation-in-part of U.S. patent application Ser. No. 11/351,701, filed on Feb. 10, 2006, now abandoned entitled "Child Training Bathroom Toilet" which claims the benefit of priority of pending provisional patent application Ser. No. 60/652,781, filed on Feb. 14, 2005, entitled "Love My Potty".

BACKGROUND OF THE INVENTION

1. Field of the Invention

This invention relates generally to a child training bathroom toilet and, more particularly, the invention relates to a child training bathroom toilet which captures a child's attention thereby facilitating the quick and efficient potty training of that child.

2. Description of the Prior Art

The anticipated arrival of a new baby is a joyous time for most couples. As the expectant mother's belly swells, an expectant father might help out by transforming his den or office into a newly decorated nursery. As diapers, bottles, and other accessories are purchased, birthing classes are attended and books are read, the coming birth is made all the more meaningful with each passing day. Friends, grandparents-to-be and other family members give thoughtful advice to the expectant parents and baby showers are thrown honoring the blessed event. Although the birth or adoption of a baby is a joyous time, nothing can fully prepare parents for the hard work involved once the baby is actually born. While children are an incredible joy, getting through the first few years of a baby's development can be extremely difficult. Fevers and tempers brought on by colic and teething can render parents concerned and frustrated while sleepless nights spent rocking a restless infant can leave them exhausted. However, snuggling a baby close to one's heart, comforting them when thy cry, or seeing a toddler take their first few steps, makes all the pitfalls of parenting more than worthwhile. Over time, parents adjust to the schedules and needs of their newborns and sleepless nights and chaotic days give way to a more relaxed routine.

While the joys of parenting have never been disputed, there is one task in regards to a child's upbringing which can be quite challenging. Specifically, potty training a child can be a trying time for both the parent and the toddler. Coaching a child in the use of the potty, encouraging them when they have the occasional "accident" and wiping away tears when a child gets frustrated, are but a few of the many occurrences experienced by parents or caregivers of potty training toddlers. Most parents agree that the first step to potty training involves purchasing a potty seat. Similar in function to a standard toilet, potty seats are scaled appropriately for use by toddlers and typically feature a removable bowl for easy cleaning and maintenance. Although extremely practical items, encouraging a child to actually sit on the potty long enough to use the facilities, can be extremely difficult. As many parents and professionals would attest, most toddlers have relatively short attention spans. Because of this, sitting in the same place for extended periods, without squirming or attempting to get up, can be a daunting task for many little ones. Resulting in a child getting up from the potty before they have actually gone to the bathroom, this inability to sit still can make the task of potty training a child that much harder.

SUMMARY

The present invention is a toilet for use with training a child. The toilet comprises a main toilet portion having a backrest and a pair of arm rests. A bowl rests within the main toilet portion. A seat is positioned over the bowl. A CD player is integrated into the main toilet portion. A plurality of finger-shaped recesses are formed on a top surface and front surface of the arm rests with the child's fingers receivable within the recesses. A sensor is positioned between the main toilet portion and the bowl with the bowl resting upon the sensor wherein upon the child contacting the finger-shaped recesses, the arm rests and recesses light up and make sounds and wherein upon bodily waste entering the bowl, the weight change of the bowl against the sensor automatically activates the CD player.

In addition, the present invention includes a method teaching a child to use a toilet. The method comprises providing a main toilet portion having a backrest and a pair of arm rests, resting a bowl within the main toilet portion, positioning a seat over the bowl, forming a plurality of finger-shaped recesses on a top surface and front surface of the arm rests, positioning a child's fingers within the recesses, activating lights and sounds in the arm rests and recesses, integrating a CD player into the main toilet portion, positioning a sensor between the main toilet portion and the bowl, and automatically activating the CD player upon bodily waste entering the bowl.

The present invention further includes a toilet for use with training a child. The toilet comprises a main toilet portion having a backrest and a pair of arm rests. A plurality of finger-shaped recesses are formed on a top surface and front surface of the arm rests with the child's fingers receivable within the recesses. A cup holder is formed in at least one of the arm rests. A bowl rests within the main toilet portion. A seat is positioned over the bowl. At least one hook secured to the main toilet portion adjacent the arm rests with each hook positioned directly under one of the arm rests and non-releasable by the child while sitting on the seat. A CD player is integrated into the main toilet portion. A sensor is positioned between the main toilet portion and the bowl wherein the arm rests are constructed from any variety of colors and light up and make sounds upon touch of the child within the recesses and wherein upon bodily waste entering the bowl, the sensor automatically activates the CD player.

DETAILED DESCRIPTION OF THE PREFERRED EMBODIMENTS

Figure 1:
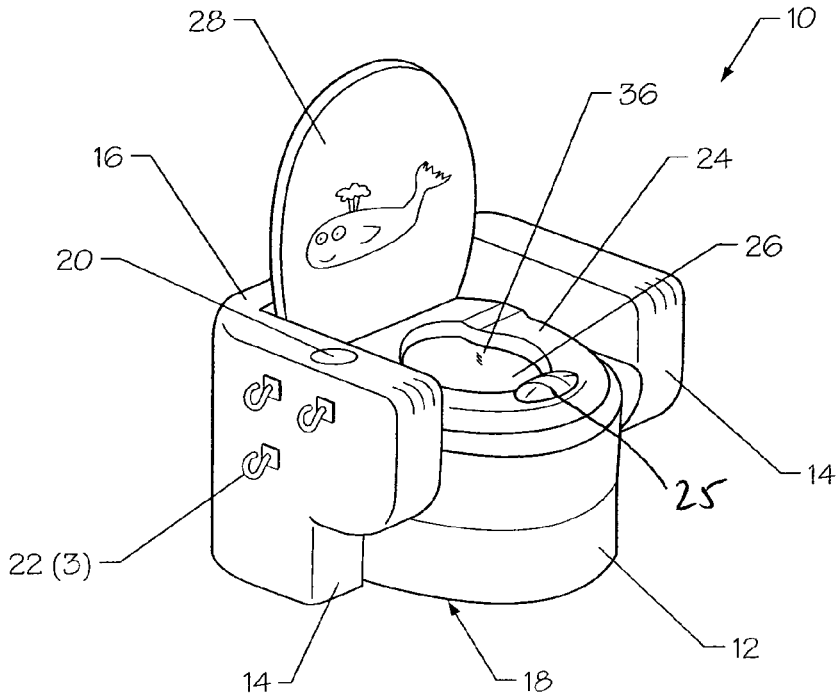
FIG. 1 is a front perspective view illustrating a child training bathroom toilet, constructed in accordance with the present invention.
Figure 2:
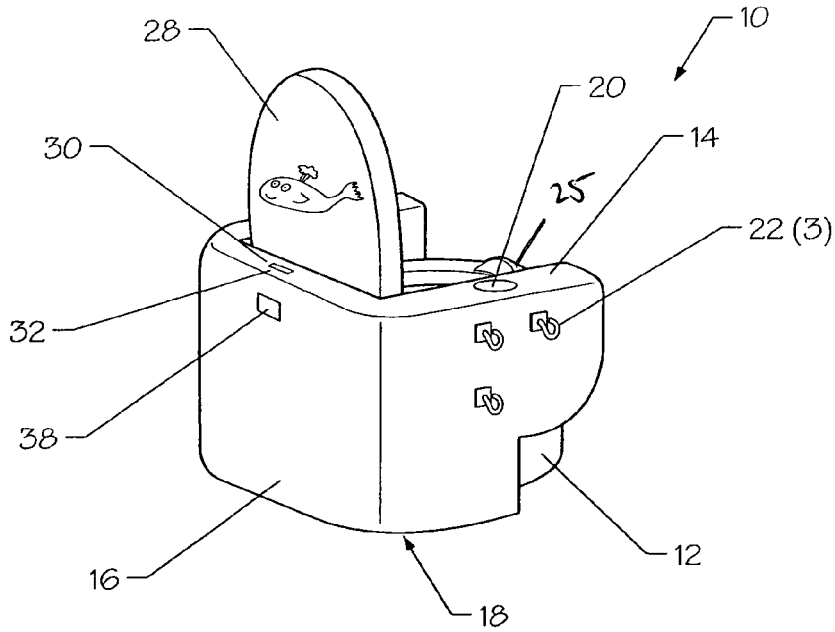
FIG. 2 is a rear perspective view illustrating the child training bathroom toilet, constructed in accordance with the present invention.
Figure 3:
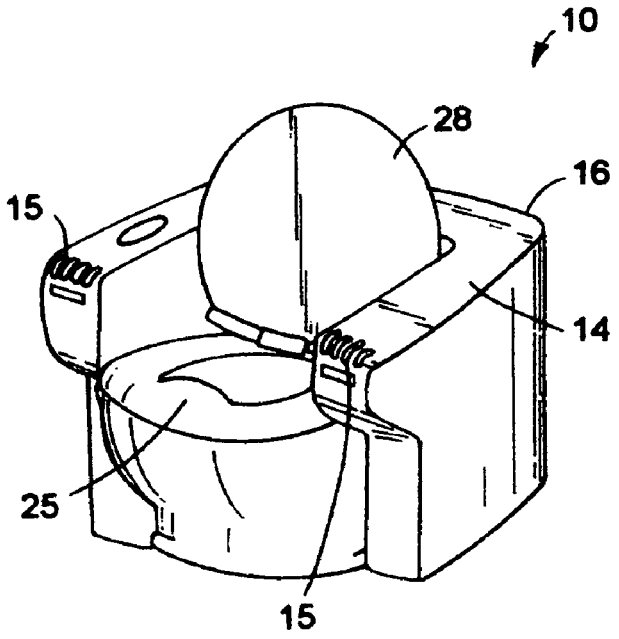
FIG. 3 is another front perspective view illustrating the child training bathroom toilet, constructed in accordance with the present invention.
Figure 4:
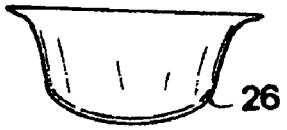
FIG. 4 is an elevational side view illustrating the child training bathroom toilet, constructed in accordance with the present invention.
Figure 4:
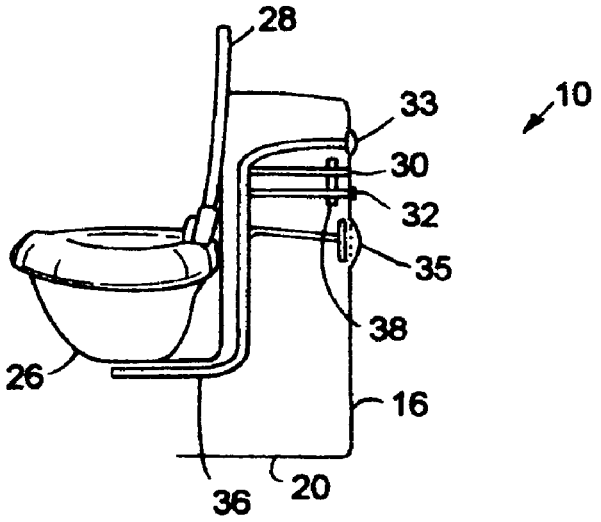
Figure 5:
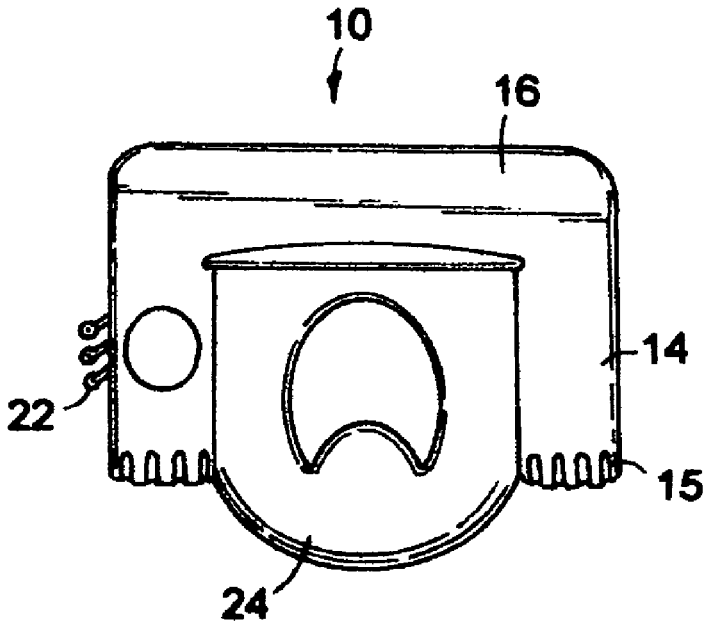
FIG. 5 is a top plan view illustrating the child training bathroom toilet, constructed in accordance with the present invention.
Figure 6:
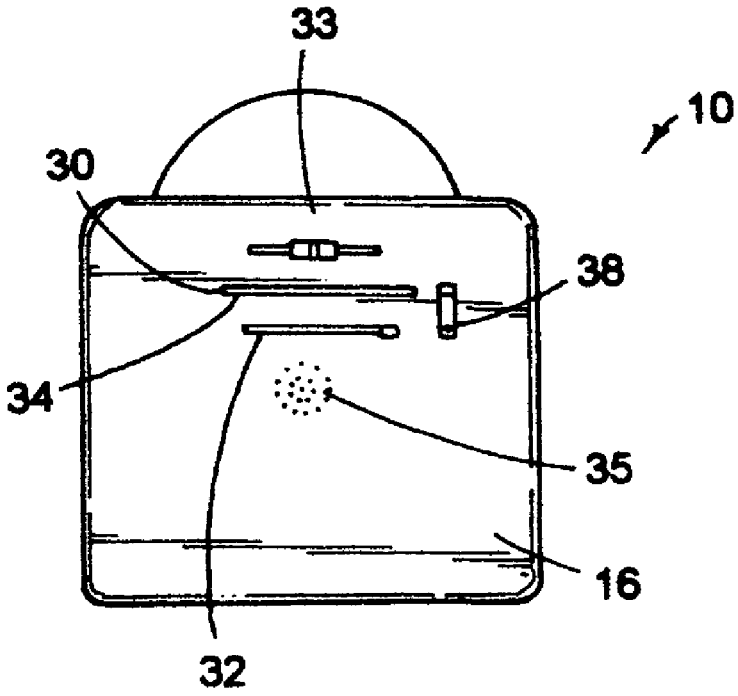
FIG. 6 is a rear elevational view illustrating the child training bathroom toilet, constructed in accordance with the present invention.

As illustrated in FIGS. 1-6, the present invention is a child training bathroom toilet, indicated generally at 10, for teaching a child to use a standard adult-sized toilet. The toilet 10 of the present invention specifically captures a child's attention thereby facilitating the quick and efficient potty training of the child.

The toilet 10 of the present invention includes a main toilet portion 12 being gently contoured to include integrated arm rests 14 and a backrest 16 and having a flat base surface 18 for resting directly on the ground. Preferably, the arm rests 14 are constructed from any variety of colors and light up and make sounds upon touch of the child. In addition, the arm rests 14 include a plurality of finger-shaped recesses 15 which, when the child positions their fingers in the recesses 15, cause the recesses 15 and the arm rests 14 to light up and make sounds. In a preferred embodiment, the recesses 15 are formed in both a top surface and a front surface of the arm rests 14 allowing a child's fingers to naturally curl around the front surface of the arm rests 14 while being received within the recesses 15. Underneath the recesses 15 is a small opening releasably sealable with a small screw for receiving a battery that is used to activate the lights and sounds. Preferably, the main toilet portion 12 is constructed from a durable, lightweight plastic material although constructing the main toilet portion 12 from other materials is within the scope of the present invention. A cup holder 20 or the like can be formed in one or both of the arm rests 14 for receiving a cup (not shown). In addition, the toilet 10 of the present invention includes specially designed hooks 22 evenly spaced about either side of the arm rests 14 on which various interactive toys (not shown) are positioned for entertaining the child while using the toilet 10. The interactive toys can be packaged and sold with the toilet 10 or can be other items desired by the parent or child. Any type of child toy can be suspended from the hooks 22 in any convenient manner. It is important that the hooks 22 have a releasable locking mechanism such that only the supervising adult is able to attach and detach the toys.

The toilet 10 of the present invention further includes an oval shaped seat 24 which is positioned directly over a substantially circular shaped, removable bowl 26. The oval shaped seat 24 is preferably removable and cushioned and can include a raised portion 25 at the front to cover a boy's private parts. For sanitary and aesthetic purposes, the removable bowl 26 is discreetly hidden beneath a hinged, oval shaped lid 28. The lid 28 is hingedly connected to the main toilet portion 12. When lifted, the lid 28 rests flush against the integrated backrest 16 located at the rear of the main toilet portion 12. The toilet 10 of the present invention can be manufactured in an array of vibrant colors and can be adorned with a wide variety of popular licensed characters including, but not limited to, Big Bird®, Bert®, Ernie®, Cookie Monster®, and Grover®, from the popular Sesame Street° series, as well as images from the hit Nickelodeon° children show "Dora the Explorer®". It should be noted that decoration of the toilet 10 of the present invention can be accomplished by the parents, if desired, with stickers, markers, or the like.

The toilet 10 of the present invention further yet includes interactive features that encourage the child to stay seated on the toilet 10. Positioned on the back rest 16 out of sight and reach of the child is a compact disc (CD) player 30 featuring an integrated volume control 32 for adjusting the volume of the CD player 30 to a desired level, a switch 33 for turning the CD player 30 either on or off and alternating between continual play and sensor activated play, and a speaker 35. The switch 33 further allows the CD player 30 to be set to play a first selection while the child is sitting on the toilet 10 and then, play a different selection, such as a song of praise, upon sensing the child has created liquid or solid waste matter, as will be described in further detail below or to play a song of praise or offer words of congratulations upon sensing the child has created liquid or solid waste material.

A slot 34 can be provided for receiving various compact discs (not shown) as desired by the parent to accomplish as set forth above. Designed to play a series of CD's boasting positive messages and words of encouragement which are developed specifically for use with the toilet 10, the CD player 30 can be activated via a sensor mechanism 36 located on the toilet 10. An eject button 37 allows the user to remove the CDs, as desired.

The removable bowl 26 is positioned directly on top of the sensor mechanism 36. Once triggered by the weight change of the bowl 26 by liquid or solid waste matter entering the bowl 26, the sensor mechanism 36 initializes the CD player 30 providing the child instant words of congratulations and praise. The CD player 30 can also be activated manually thus entertaining the child with music or stories as they sit on the toilet 10. Appropriate switching and wiring are provided to accomplish the goals and features of the present invention.

Preferably, the CD player 30 of the toilet 10 of the present invention is powered by an internally contained battery such as a standard nine-volt of D alkaline battery located within a battery compartment 38 in the main toilet portion 12. Powering the CD player 30 of the toilet 10 by other means is also within the scope of the present invention.

The toilet 10 of the present invention further includes an adjustable seat belt 37 with a latching mechanism for releasably securing the seat belt 37 about the child. The seat belt 37 assures that the child does not accidentally fall from the toilet 10 while in use.

The use of the toilet 10 of the present invention will now be described in detail. It will be understood by those persons skilled in the art that the manner of use of using the toilet 10 described herein is simply one manner of use and other manners of use are within the scope of the present invention.

The toilet 10 is positioned on a flat, horizontal surface in a desired location. For instance, the parent or caregiver positions the toilet 10 in a designated area within the home, such as a bathroom. To use the toilet 10, the child simply lifts up the toilet seat lid 28, sitting down on the seat 24 of the toilet 10 as they would any other conventional potty chair. As the child sits, he or she can remove one or more of the interactive toys located on the integrated hook closures 22 positioned on either side of the main toilet portion 12 thus serving to pass the time spent sitting on the toilet 10 in a fun and entertaining manner. Once the child has completed his or her use of the facilities, the sensor mechanism 36 located at the bottom of the removable bowl 26 is activated thereby activating the integrated CD player 30. When this occurs, the encouraging sounds of praise and congratulations are heard throughout the bathroom, as well as alerting Mom or Dad to a job well done. After use, the toilet bowl 26 is emptied, cleaned, and set back in the main toilet portion 12 of the toilet 10, until the toilet 10 is again needed.

The toilet 10 of the present invention is a unique product offering consumers many significant benefits and advantages. Foremost, the toilet 10 effectively encourages a child in the use of the potty. Featuring a fully functioning compact disc player 30, the toilet 10 provides a fun and friendly way in which to keep a child entertained and occupied for extensive periods while they sit on the toilet 10. Capturing a child's attention and imagination through entertaining, interactive toys, the toilet 10 provides simulating auditory congratulations and encouragement once a child has successfully used the toilet 10. Because of this, a child who routinely uses the toilet 10 of the present invention effectively learns to use the toilet 10 in a faster, more efficient manner.

A learning tool, parents and caregivers appreciate that with the toilet 10 of the present invention, their child learns to associate the toilet 10 with its designated function thus greatly reducing the "accidents" which so often occur when a child is potty trained. Alerting the parent, via the integrated sensor mechanism 36 and compact disc player 30, that the child has successfully utilized the potty, the toilet 10 provides an auditory reminder to Moms and Dads that their child deserves parental praise. Portable, the toilet 10 is easily packed for a family vacation or event for an afternoon trip to Grandma's house. Although designed with the general household use in mind, the toilet 10 is well suited for use in day care centers and similar establishments. Durably constructed of heavy-duty plastic materials, the toilet 10 can be passed down from one child to the next, ensuring years of continual use.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the'invention, and that the scope of the present invention is to be limited only to the claims except as precluded by the prior art. Moreover, the invention as disclosed herein, may be suitably practiced in the absence of the specific elements which are disclosed herein.

What is claimed is:

1. A toilet for use with training a child, the toilet comprising:

a main toilet portion having a backrest and a pair of arm rests;

a bowl resting within the main toilet portion;

a seat positioned over the bowl;

a CD player integrated into the main toilet portion;

a plurality of finger-shaped recesses formed on a top surface and front surface of the arm rests, the child's fingers receivable within the recesses; and a sensor positioned between the main toilet portion and the bowl, the bowl resting upon the sensor;

wherein upon the child contacting the finger-shaped recesses, the arm rests and recesses light up and make sounds; and wherein upon bodily waste entering the bowl, the weight change of the bowl against the sensor automatically activates the CD player.

2. The toilet of claim 1 wherein the main toilet portion is constructed from a plastic material, the backrest and arm rests being integrally constructed.

3. The toilet of claim 1 and further comprising:

a lid closable over the bowl, the lid hingedly connected to the main toilet portion.

4. The toilet of claim 1 wherein the CD player includes a volume control.

5. The toilet of claim 1 wherein upon being automatically activated, the CD plays words or songs of encouragement to the child.

6. The toilet of claim 1 wherein the CD player plays any desired CD, the CD player playing a first selection and a second selection, the first selection playing as the child sits on the toilet, the second selection playing when the child has a liquid or solid waste enter the bowl.

7. The toilet of claim 1 wherein the seat is padded.

8. The toilet of claim 1 wherein the arm rests are constructed from any variety of colors and light up and make sounds upon touch of the child.

9. The toilet of claim 1 and further comprising:

a cup holder formed in at least one of the arm rests.

10. The toilet of claim 1 and further comprising:

at least one hook secured to the main toilet portion adjacent the arm rests, each hook positioned directly under one of the arm rests, the hooks being constructed to releasably lock a toy to the hooks.

11. A method for teaching a child to use a toilet, the method comprising:

providing a main toilet portion having a backrest and a pair of arm rests;

resting a bowl within the main toilet portion;

positioning a seat over the bowl;

forming a plurality of finger-shaped recesses on a top surface and front surface of the arm rests;

positioning a child's fingers within the recesses;

activating lights and sounds in the arm rests and recesses, when a child's fingers are positioned within said recesses;

integrating a CD player into the main toilet portion;

positioning a sensor between the main toilet portion and the bowl; and automatically activating the CD player upon bodily waste entering the bowl.

12. The method of claim 11 and further comprising:

securing at least one hook to the main toilet portion directly under the arm rests; and releasably locking a toy to the hook.

13. The method of claim 11 and further comprising:

integrally constructing the backrest and arm rests with the main toilet portion.

14. The method of claim 11 and further comprising:

hingedly connecting a lid to the main toilet portion.

15. The method of claim 11 and further comprising:

providing a volume control for the CD player.

16. The method of claim 11 and further comprising:

playing words or songs of encouragement to the child when the CD player is automatically activated.

17. The method of claim 11 and further comprising:

playing any desired CD in the CD plays.

18. A toilet for use with training a child, the toilet comprising:

a main toilet portion having a backrest and a pair of arm rests;

a plurality of finger-shaped recesses formed on a top surface and front surface of the arm rests, the child's fingers receivable within the recesses;

a cup holder formed in at least one of the arm rests;

a bowl resting within the main toilet portion;

a seat positioned over the bowl;

at least one hook secured to the main toilet portion adjacent the arm rests, each hook positioned directly under one of the arm rests and non-releasable by the child while sitting on the seat;

a CD player integrated into the main toilet portion; and a sensor positioned between the main toilet portion and the bowl;

wherein the arm rests are constructed from any variety of colors and light up and make sounds upon touch of the child within the recesses; and wherein upon bodily waste entering the bowl, the sensor automatically activates the CD player.

19. The toilet of claim 18 wherein the seat is padded.

20. The toilet of claim 18 wherein the CD player plays any desired CD, the CD player playing a first selection and a second selection, the first selection playing as the child sits on the toilet, the second selection playing when the child has a liquid or solid waste enter the bowl.

* * * * *